US005165139A

United States Patent [19]

Oxman

[11] Patent Number: 5,165,139

[45] Date of Patent: Nov. 24, 1992

[54] MOBILE CLEANING UNIT

[75] Inventor: Myron P. Oxman, Kingston, Canada

[73] Assignee: Tecnically Engineered Cleaning Hydraulic Systems, Kingston, Canada

[21] Appl. No.: 829,387

[22] Filed: Feb. 3, 1992

[51] Int. Cl.[5] ..... A47L 11/34

[52] U.S. Cl. ..... 15/321; 15/340.1

[58] Field of Search ..... 15/321, 340.1, 320, 15/349, 348

[56] References Cited

U.S. PATENT DOCUMENTS 4,109,340 8/1978 Bates ..... 15/321
4,158,248 6/1979 Palmer ..... 15/321
4,284,127 8/1981 Collier et al. ..... 15/321 X
4,862,551 9/1989 Martinez et al. ..... 15/321
4,991,254 2/1991 Roden et al. ..... 15/321

*Primary Examiner*—Chris K. Moore
*Attorney, Agent, or Firm*—Richard J. Hicks

[57] ABSTRACT

A self contained mobile unit for cleaning carpets or other industrial cleaning applications and for liquid recovery and storage is described. The unit contains large fresh water and waste water storage tanks and a high pressure water pump and vacuum blower unit. The water pump and blower are powered by a hydraulic motor which in turn is powered by a hydraulic pump driven from a power take off from the main motive engine of the mobile unit.

7 Claims, 4 Drawing Sheets

MOBILE CLEANING UNIT

FIELD OF INVENTION

This invention relates to a self contained mobile cleaning unit for cleaning carpets, high pressure washing of public, commercial and industrial buildings and the like, and for recovering various liquids, such as spillages or floods.

BACKGROUND OF INVENTION

Numerous truck mounted pressure washing systems have been suggested in the past which generally include selectively engageable auxiliary apparatus including a waste pump and a vacuum blower which are powered either by the main truck engine or by an auxiliary internal combustion engine. Provision is generally made for a self contained waste supply tank and in some instances the wash water is preheated by a heat exchanger in circuit with the cooling system for the truck engine. Attention is directed to U.S. Pat. Nos. 4,158,248; 4,109,340; 4,284,127; 4,336,627; and 4,443,909 all of which are illustrative of the prior art. Those units in which the pump and blower are powered by the main truck are provided with either belts or shafts from the power take off of the engine to transmit the power to the pump and blower mounted in the back of the truck. Belts have to be shielded, are very cumbersome, and the power transmitted is strictly limited due to slack in the belts and slippage. Shafts permit somewhat greater power transmission but take up a great deal of room in the truck and must be located in extremely inconvenient positions. The power that can be transmitted is limited by the size of the shaft which can be installed and in practice it has been found that in a one ton truck (the standard in the carpet cleaning industry), the maximum pump pressure that can be generated is about 1100 psi, which is sufficient only for cleaning carpets in buildings up to about 6 stories high. Mobile units which include an auxiliary internal combustion engine to power the pump and blower are not very efficient as a suitably sized auxiliary is noisy and takes up considerable cargo space in the vehicle. There is, therefore, a considerable need for a mobile cleaning unit which can provide much higher water pressures for high pressure industrial washing and cleaning carpets in buildings as high as 25 stories from the street level positioned mobile truck unit. There is also a need for a mobile unit which is relatively quiet in operation in view of noise pollution by-laws, and which has a large capacity feed water tank and an equally large waste water tank as pollution by-laws now frequently prohibit dumping of raw waste water into public storm sewers. As noted above neither the belt or shaft driven main engine configurations nor the auxiliary engine configuration can provide the necessary pressure, low noise level and water storage capacity.

OBJECT OF INVENTION

It is, therefore, an object of the present invention to provide a mobile cleaning unit which is equipped to provide a high pressure water supply of up to about 2600 psi and up to about 150 gallons fresh water and waste water tanks (in contrast to the conventional 65 gallon tanks) and which can be operated at constant, relatively low main enging speed so as to minimize noise pollution.

BRIEF STATEMENT OF INVENTION

Thus by one aspect of this invention there is provided a mobile cleaning system mounted in a motor vehicle having an internal combustion engine and a cargo carrying area, said system comprising:

hydraulic pump means operatively and selectively driven by said internal combustion engine;

hydraulic motor means mounted in said cargo carrying area and operatively connected to said hydraulic pump means; and high pressure water pump means and vacuum pump means mounted in said cargo carrying space and selectively driven by said hydraulic pump means.

DETAILED DESCRIPTION OF PREFERRED EMBODIMENTS

Figure 1:
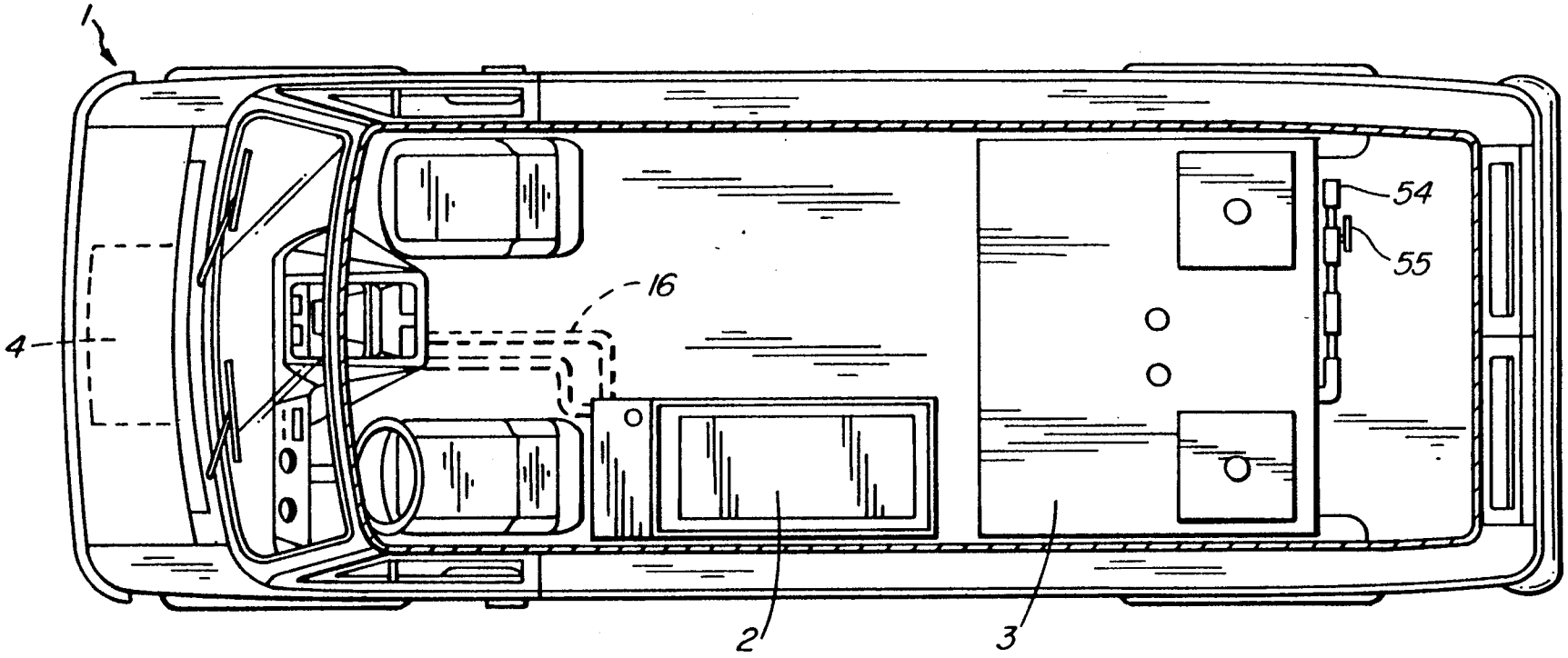
FIG. 1 is a plan view of a truck containing the cleaning equipment according to the present invention.
Figure 2:
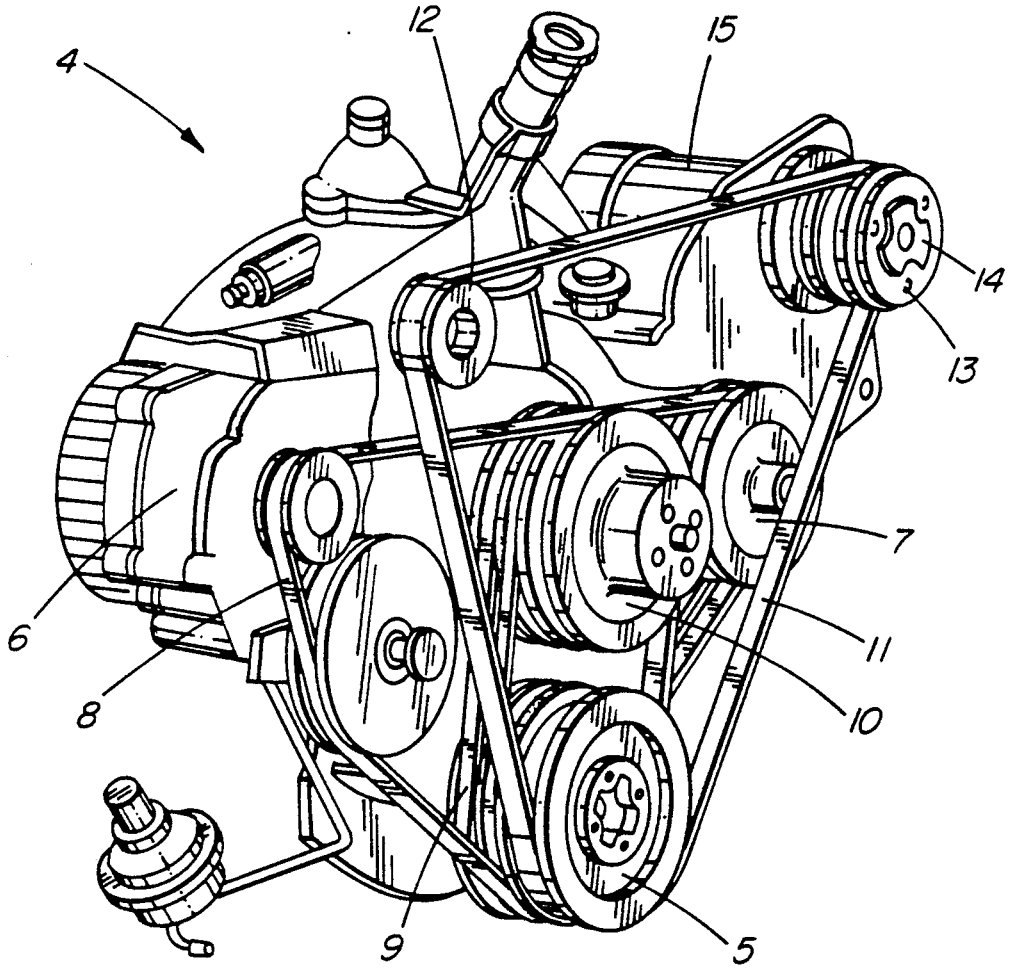
FIG. 2 is a sketch of a truck engine showing the hydraulic motor.
Figure 3A:
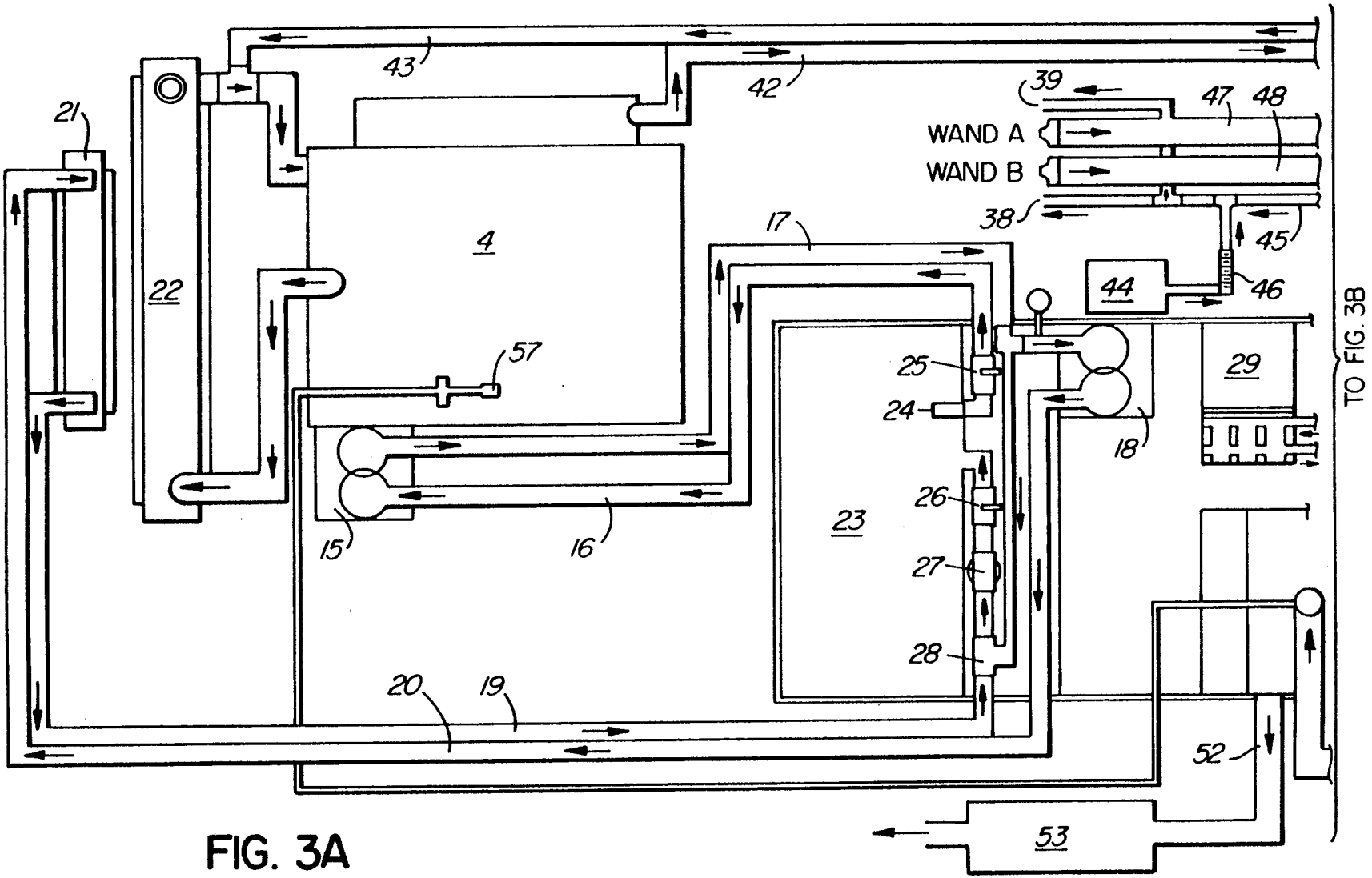
FIGS. 3*a* and 3*b* are a schematic block diagram of the mobile system of the present invention.
Figure 3B:
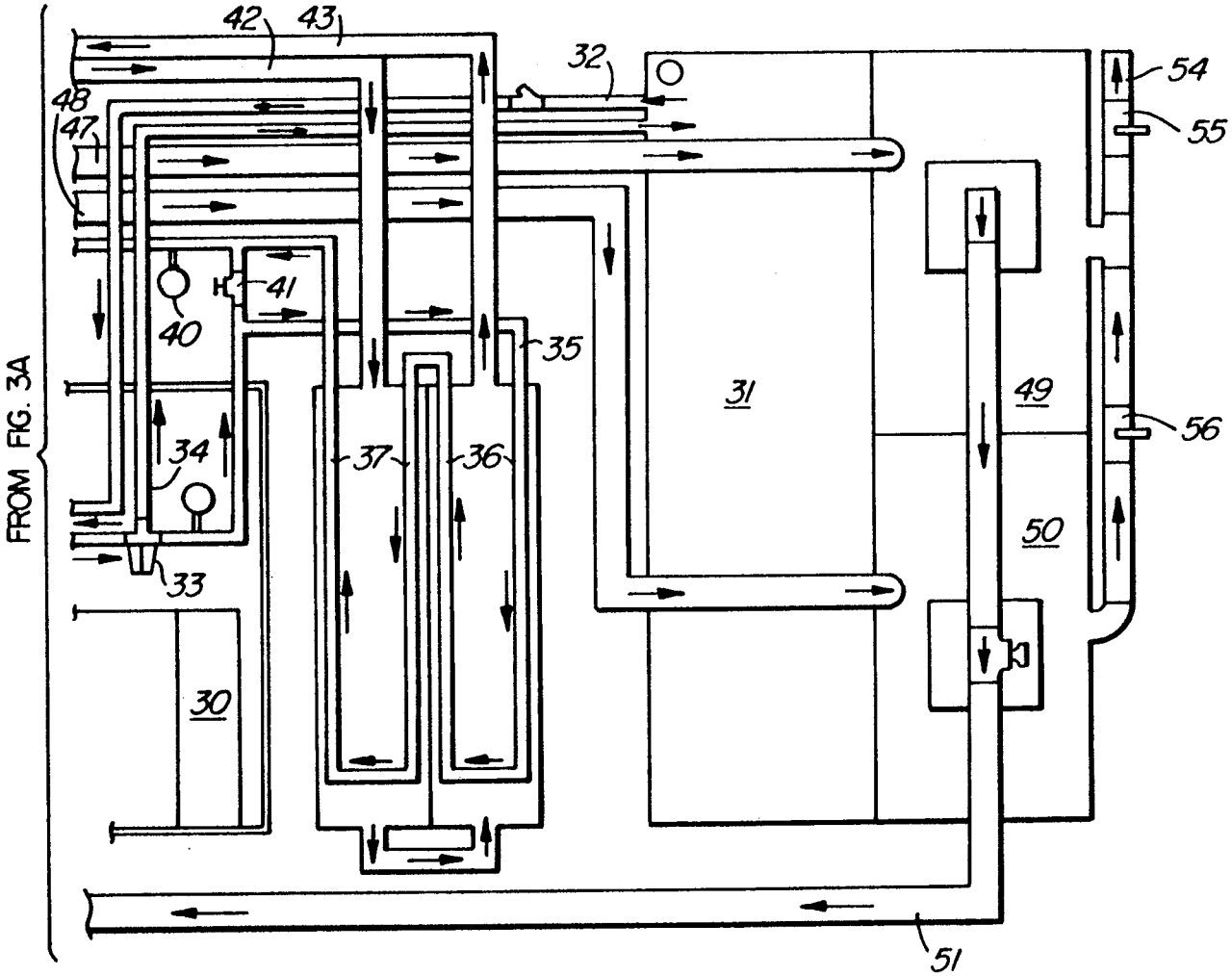

As can be seen from FIG. 1, a cleaning vehicle such as a van or truck 1 contains a mobile carpet cleaning unit 2, fresh and waste water tanks 3 and an engine 4. It will be appreciated that engine 4 is the main motive power for the truck 1 and may be a conventional diesel or gasoline engine such as customarily installed in commercially available vehicles from numerous manufacturers, such as General Motors, Ford and Chrysler. As seen more readily in FIG. 2, engine 4 is provided with a standard power take off pulley 5 which drives a standard altenator 6 and power steering pump 7 by belt 8. Belt 9 drives a fan (not shown) mounted on pulley 10. An additional belt 11 passes around pulley 5, tensioner pulley 12 and pulley 13 which is controlled by electric clutch 14. When engaged, pulley 13 drives hydraulic pump 15 which in turn is connected by hydraulic lines 16, 17 to a hydraulic motor 18 (as seen in FIGS. 3*a* and 3*b*) associated with the cleaning unit 2 at the back of the truck 1. Hydraulic lines 16, 17 are, of course very small and can be routed in any convenient manner under the truck floor so as to provide the maximum of usable cargo space in the vehicle. Motor 18 is cooled by circulating oil through lines 19, 20 and through oil cooler 21 mounted in front radiator 22. Reserve hydraulic fluid is contained in tank 23 which is provided with a strainer 24 and feed line and return line valves 25 and 26. Filters 27 and 28 may be provided in return line 19. Hydraulic motor 18 drives a high pressure water pump 29 and a blower 30. Water from the clean water tank 31 is drawn via feed line 32 through pump 29, unloader valve 33 to either by-pass line 34 or high pressure line 35 and thence via heat exchangers 36, 37 or directly to the water outlet hoses 38, 39 of wands A & B as determined by temperature gauge 40 and temperature valve 41. Heat exchangers 36 and 37 are also operatively connected via hoses 42, 43 to the radiator 22 of engine 4, in conventional manner so that waste engine heat is used to preheat the feed water from tank 31. A detergent tank 44 containing a suitable and conventional liquid carpet cleaning detergent may be provided in the high pressure hot water line 45, and controlled by a metering valve 46. The vacuum side of blower 30 is connected to hand held wands A and B to provide vacuum inlets 47, 48 respectively to suck the waste dirty water, previously applied to the carpet via the hoses 38, 39, out of the carpet and return it to waste water tanks 49, 50. The dirty water is separated from entrained air in tanks 49, 50 and the air continues through conduit 51 to blower 30 from which it is discharged to atmosphere via outlet pipe 52 and muffler 53. Dirty water is periodically dumped from tanks 49, 50 via outlet 54, controlled by values 55, 56 respectively, into an environmentally approved dump site or drainage system. In operation, when wands A and B are at a work site remote from the vehicle, aqnd this can be as much as about 26 storeys above the street, the operator covers vacuum inlet 47 or 48 and vacuum advance 57 connected in series with a throttle control revs the truck engine to a predetermined speed, usually about 1150 r.p.m. It will be appreciated that hydraulic motor 18 is very compact in size but can provide sufficient power to drive a very high pressure water pump 29 which may generate water pressures up to about 2600 psi, which is sufficient to provide good cleaning pressures even in very tall buildings. Similarly, blower 30 is also extremely high capacity and provides very high vacuum pressures at the wands A & B. Because motor 18 pump 29 and blower 30, are compact in size, the cleaning unit 2 is also small in size which leaves considerable extra cargo space in vehicle 1 to accommodate the extra large fresh water tank 31 and extra large waste water tanks 49, 50. A large fresh water tank 31 is important as it reduces the number of trips to a water supply point and hence increases productivity of the unit. Similarly, large waste water storage tanks reduce the number of trips to empty the tanks and, more importantly, provides a storage capacity so that the waste water, which may be considered an environmentally hazardous waste, can be safely dumped into an appropriate facility rather than dumping into a municipal storm sewer. Environmetal regulations prohibit dumping of carpet cleaning wastes into municipal storm sewers and the like.

It will be appreciated that, while a carpet cleaning vehicle has been described in detail hereinabove, this invention may also be used in numerous other environments and applications, such as the recovery of waste or other spilled liquids and for pumping out flooded buildings, tanks, sumps and the like. With an adapter (not shown) this invention may also be used for driving pneumatic tools and for such cleaning operations as sand blasting.

I claim:

1. A mobile system for cleaning and liquid recovery mounted in a motor vehicle having an internal combustion engine and a cargo carrying area, said system comprising:

hydraulic pump means operatively and selectively driven by said internal combustion engine;

hydraulic motor means mounted in said cargo carrying area and operatively connected to said hydraulic pump means; and high pressure water pump means and vacuum pump means mounted in said cargo carrying space and selectively driven by said hydraulic pump means.

2. A mobile system as claimed in claim 1 including a water supply tank and waste water storage tank mounted in said cargo carrying space.

3. A mobile system as claimed in claim 2 including heat exchanger means downstream of said high pressure water pump means and operatively connected to a cooling system for said internal combustion engine, so as to preheat water from said water supply tank before use in said cleaning system.

4. A mobile system as claimed in claim 3 including wand means to deliver high pressure heated water to an object to be cleaned and means to vacuum said water away from said object.

5. A mobile unit as claimed in claim 4 wherein said object to be cleaned is a carpet.

6. A mobile unit as claimed in claim 5 including means to inject cleaning chemicals into said heated water upstream of said wand means.

7. A mobile unit as claimed in claim 5 wherein said high pressure water pump means generates water pressures up to about 2600 psi.

* * * * *